US012680787B2

(12) United States Patent
Lin

(10) Patent No.: US 12,680,787 B2
(45) Date of Patent: Jul. 14, 2026

(54) PROTECTIVE COVER FOR SIGHTING DEVICE

(71) Applicant: Alan Nathan Lin, Arcadia, CA (US)

(72) Inventor: Alan Nathan Lin, Arcadia, CA (US)

( * ) Notice: Subject to any disclaimer, the term of this patent is extended or adjusted under 35 U.S.C. 154(b) by 0 days.

(21) Appl. No.: 18/954,241

(22) Filed: Nov. 20, 2024

(65) Prior Publication Data

US 2025/0076004 A1 Mar. 6, 2025

Related U.S. Application Data

(63) Continuation-in-part of application No. 18/111,816, filed on Feb. 20, 2023, now Pat. No. 12,320,617.

(51) Int. Cl.
*F41G 1/30* (2006.01)
*F41G 11/00* (2006.01)

(52) U.S. Cl.
CPC ..... *F41G 11/00* (2013.01)

(58) Field of Classification Search
CPC ..... F41A 35/02; F41G 1/30; F41G 1/38
USPC ..... 42/143
See application file for complete search history.

(56) References Cited

U.S. PATENT DOCUMENTS

| | | | | |
|---|---|---|---|---|
| 8,904,697 | B2 * | 12/2014 | Park | F41G 1/383 42/129 |
| 10,704,862 | B2 * | 7/2020 | Chung | F41G 3/065 |
| 10,921,091 | B2 * | 2/2021 | Borrico | F41G 1/30 |
| 10,948,264 | B1 * | 3/2021 | Brumfield | F41G 1/30 |
| 2012/0102804 | A1 * | 5/2012 | Fesas | F41A 3/66 42/90 |
| 2015/0323278 | A1 * | 11/2015 | Pisani | F41A 35/02 42/96 |
| 2017/0102204 | A1 * | 4/2017 | Mezynski | F41G 1/54 |
| 2017/0142301 | A1 * | 5/2017 | Simmon | F41G 11/00 |
| 2022/0026175 | A1 * | 1/2022 | Chavez | F41G 1/30 |
| 2022/0390206 | A1 * | 12/2022 | Hamilton | F41G 1/345 |
| 2022/0390207 | A1 * | 12/2022 | Chavez | F41G 1/01 |
| 2023/0054268 | A1 * | 2/2023 | Schulte | F41G 1/30 |
| 2023/0142324 | A1 * | 5/2023 | Campbell | F41G 11/003 42/113 |
| 2023/0411763 | A1 * | 12/2023 | Sheets, Jr. | F41G 11/003 |
| 2024/0011739 | A1 * | 1/2024 | Smith | F41G 1/345 |
| 2024/0044605 | A1 * | 2/2024 | Sanders | F41C 23/16 |

* cited by examiner

*Primary Examiner* — Michael D David
(74) *Attorney, Agent, or Firm* — Che-Yang Chen; Law Office of Michael Chen

(57) ABSTRACT

A protective cover for a device installed on a firearm includes a cover body having a housing portion and a base portion integrally and inwardly extended from the housing portion; wherein the cover body includes an inner surface having at least one securing protrusion configured to match with an outer surface of the device for tightly securing the cover body on the device.

17 Claims, 28 Drawing Sheets

PROTECTIVE COVER FOR SIGHTING DEVICE

FIELD OF THE DISCLOSURE

The present disclosure relates to a protective cover, and more particularly to a protective cover for a device, such as sighting devices, reflex sights, or scope devices with a cover body configured to be covered on the device, even during the performance of operational actions such as aiming, shooting, and against recoil without removing the protective cover.

BACKGROUND OF THE DISCLOSURE

Generally, miniature reflex sights, also commonly known as mini red-dot sights, are non-magnifying reflector sights that are commonly used with handguns and small armaments, such as rifles and crossbows. Reflex sights are also used for other aiming purposes, for example as a finder scope for use with a telescope. Reflex sights typically include a partially reflecting transparent element, such as a lens or flat glass element, that the user looks through to view a target and an illuminated aiming mark or reticle pattern. In a reflex sight utilizing a reflecting lens element, the aiming mark is typically generated by a small light emitting diode at the focal point of the lens. In reflex sights, including a flat glass element, the aiming mark is generated by an illumination source directed toward the flat glass element.

However, the above-mentioned reflex sight may be cumbersome to use during exposure to the daylight/sunlight. While the reflex sight is exposed under the sunlight or high intensity of daylight, the UV lights may interfere with the aiming mark, and in such a situation, the user may have a hassle locating the targets, to cause miss-shooting.

Currently, to protect the sighting device (reflex sight or scope), a protective cover may be used to cover on; however, while the current protective cover is covered on the sighting device, the function of aiming cannot be approached. In addition, the current protective cover easily falls down, and there is no appropriate way to securely secure the protective cover on the sighting device.

There may be a desire to develop a protective cover that can effectively reduce the interference generated by daylight/sunlight with the aiming mark.

All referenced patents, applications, and literature are incorporated herein by reference. Furthermore, where a definition or use of a term in a reference, which is incorporated by reference herein, is inconsistent or contrary to the definition of that term provided herein, the definition of that term provided herein applies, and the definition of that term in the reference does not apply. The disclosed embodiments may seek to satisfy one or more of the above-mentioned desires. Although the present embodiments may obviate one or more of the above-mentioned desires, it should be understood that some aspects of the embodiments might not necessarily obviate them.

BRIEF SUMMARY OF THE DISCLOSURE

In a general implementation, a protective cover for a device installed on a firearm may comprise a cover body having a housing portion and a base portion integrally and inwardly extended from the housing portion; wherein the cover body comprises an inner surface having at least one securing protrusion configured to match with an outer surface of the device for tightly securing the cover body on the device.

In another aspect combinable with the general implementation, the outer surface of the device comprises at least one indented slot, wherein each of the indented slots corresponds to each of the at least one securing protrusion.

In another aspect combinable with the general implementation, each of the at least one securing protrusion is horizontally extended across an entire surface of one or both of two cover side walls of the cover body.

In another aspect combinable with the general implementation, the outer surface of the device comprises at least one indented slot, wherein each of the at least one securing protrusion is inserted into each of the indented slots, wherein each of the at least one indented slot is inwardly and horizontally extended on the outer surface of the device.

Further, it is contemplated that the at least one securing protrusion comprises a first securing protrusion and a second securing protrusion parallelly arranged with the first securing protrusion, wherein the first securing protrusion is arranged adjacent to a top cover wall of the cover body and the second securing protrusion is arranged adjacent to the base portion of the cover body.

Further, it is contemplated that the outer surface of the device comprises a first indented slot and a second indented slot parallelly arranged with the first indented slot, wherein the first indented slot is arranged adjacent to a top portion of the device and the second indented slot is arranged adjacent to a bottom portion of the device.

It is still further contemplated that each of the at least one securing protrusion is upwardly and integrally extended from the inner surface of the cover body.

In another aspect combinable with the general implementation, the cover body comprises a vision opening formed on a front cover wall of the cover body and a rear vision opening formed on a rear cover wall of the cover body, wherein the front cover wall is arranged on an opposite side of the rear cover wall.

In another aspect combinable with the general implementation, the device comprises a top portion, a bottom portion integrally extended from the top portion and configured to be installed on the firearm, and a middle portion formed between the top portion and the bottom portion, wherein the middle portion comprises two side walls where the at least one indented slot are formed thereon.

In another aspect combinable with the general implementation, the base portion comprises a right base portion and a left base portion integrally and transversely extended from the right base portion, wherein the housing portion comprises two cover side walls and the at least one securing protrusion are formed on the inner surface of the two cover side walls.

In another aspect combinable with the general implementation, the cover body comprises an indented cavity formed on a base portion of the cover body, wherein the indented cavity is inwardly extended from the inner surface of the cover body and configured to match with the outer surface of the device.

In another aspect combinable with the general implementation, the inner surface of the base portion of the cover body comprises an indented cavity, and the device comprises a button outwardly extended from the outer surface of the device, which is inserted into the indented cavity.

In another aspect combinable with the general implementation, the at least one indented slot is horizontally extended across an entire surface of a side wall of the device.

In another aspect combinable with the general implementation, the housing portion comprises a front bottom edge rearwardly and indentedly extended towards a rear vision opening to form a front indented contour.

In another aspect combinable with the general implementation, the housing portion comprises a rear bottom edge frontward and indentedly extended towards a vision opening to form a rear indented contour, wherein the rear vision opening is arranged on an opposite side of the vision opening.

In another aspect combinable with the general implementation, the housing portion comprises two cover side walls, a front cover wall integrally extended from the two cover side walls, and a rear cover wall integrally extended from the two cover side walls to form a sloped wall, wherein each of the two cover side walls comprises a cover side wall height which is longer than a front cover wall height defined by the front cover wall.

In another aspect combinable with the general implementation, the housing portion comprises two cover side walls, a front cover wall integrally extended from the two cover side walls, and a rear cover wall integrally extended from the two cover side walls, wherein each of the two cover side walls comprises a cover side wall height which is longer than a rear cover wall height defined by the rear cover wall.

In another aspect combinable with the general implementation, the outer surface of the device comprises an indented slot integrally and transversely extended from one of two side walls of the device to a top portion of the device and a button arranged on the other one of the two side walls of the device.

In another aspect combinable with the general implementation, the button is extended from a top edge of one of two side walls of the device to a bottom edge of the one of the two side walls of the device, wherein the top edge of the device is formed on an opposite side of the bottom edge of the device.

In another aspect combinable with the general implementation, the at least one securing protrusion comprises a securing protrusion upwardly and integrally extended from the inner surface of one of two cover side walls of the cover body to the inner surface of a top cover wall of the cover body.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above and below as acting in certain combinations and even initially claimed as such, one or more features from a claimed combination can in some cases be excised from the combination, and the claimed combination may be directed to a subcombination or variation of a subcombination.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

It should be noted that the drawing figures may be in simplified form and might not be to precise scale. In reference to the disclosure herein, for purposes of convenience and clarity only, directional terms such as top, bottom, left, right, up, down, over, above, below, beneath, rear, front, distal, and proximal are used with respect to the accompanying drawings. Such directional terms should not be construed to limit the scope of the embodiment in any manner.

DETAILED DESCRIPTION OF THE EMBODIMENTS

The different aspects of the various embodiments can now be better understood by turning to the following detailed description of the embodiments, which are presented as illustrated examples of the embodiments defined in the claims. It is expressly understood that the embodiments as defined by the claims may be broader than the illustrated embodiments described below.

The term "a" or "an" entity refers to one or more of that entity. As such, the terms "a" (or "an"), "one or more" and "at least one" can be used interchangeably herein. It is also to be noted that the terms "comprising," "including," and "having" can be used interchangeably.

It shall be understood that the term "means," as used herein, shall be given its broadest possible interpretation in accordance with 35 U.S.C., Section 112(f). Accordingly, a claim incorporating the term "means" shall cover all structures, materials, or acts set forth herein and all thereof. Further, the structures, materials or acts and the equivalents thereof shall include all those described in the summary of the invention, brief description of the drawings, detailed description, abstract, and claims themselves.

Unless defined otherwise, all technical and position terms used herein have the same meaning as commonly understood by one of ordinary skill in the art to which the invention pertains. Although many methods and materials similar, modified, or equivalent to those described herein can be used in the practice of the present invention without undue experimentation, the preferred materials and methods are described herein. In describing and claiming the present invention, the following terminology will be used in accordance with the definitions set out below.

A "lens peripheral edge" of the lens shield, as used herein, refers to the external boundary of a lens shield of the invention. In addition, a "peripheral edge" of a vision opening, as used herein, refers to the external boundary of the vision opening of the invention.

Figure 1:
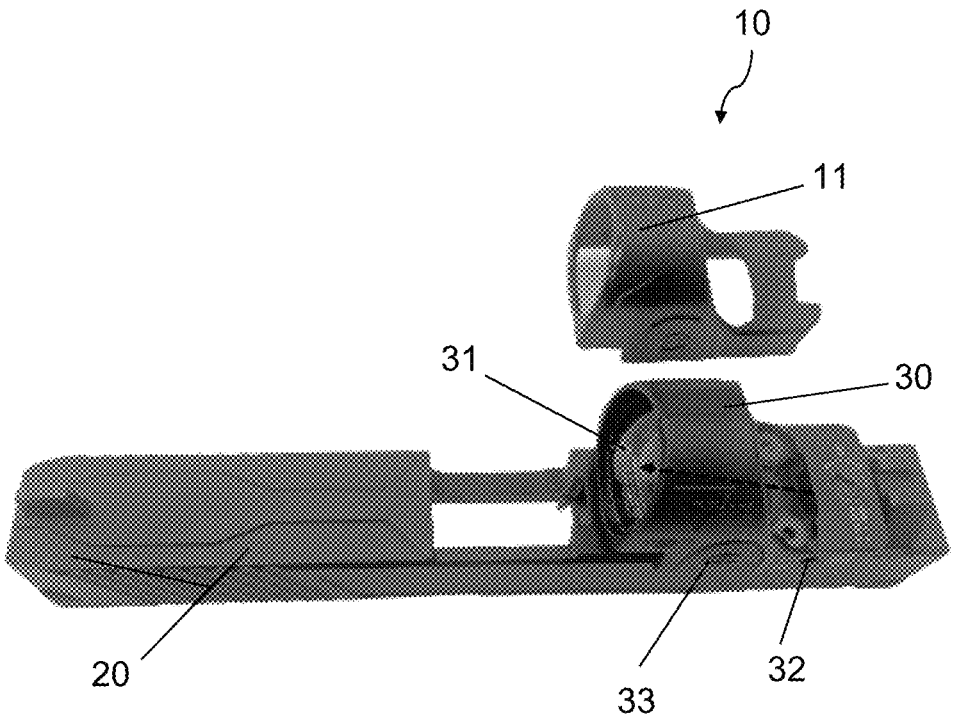
FIG. 1 is a perspective view of a protective cover for a sighting device installed on a firearm according to an aspect of the embodiment.

FIG. 1 generally depicts a perspective view of a protective cover 10 for a sighting device 30 installed on a firearm 20 according to an aspect of the embodiment.

Referring to FIG. 1, the protective cover 10 may comprise a cover body 11 configured to be couplable to a sighting device 30, wherein the sighting device 30 may be detachably mounted on the firearm 20. In one embodiment, the sighting device 30 may generate a light source that may be transmitted to a reflective lens 31 of the sighting device 30. It should be noted that, in some embodiments, the sighting device 30 may be any compatible sight, scope, or optics. It should be understood that the sighting device 30 are exemplary and any other sighting device 30 can be adopted in various embodiments of this disclosure.

Figure 2A:
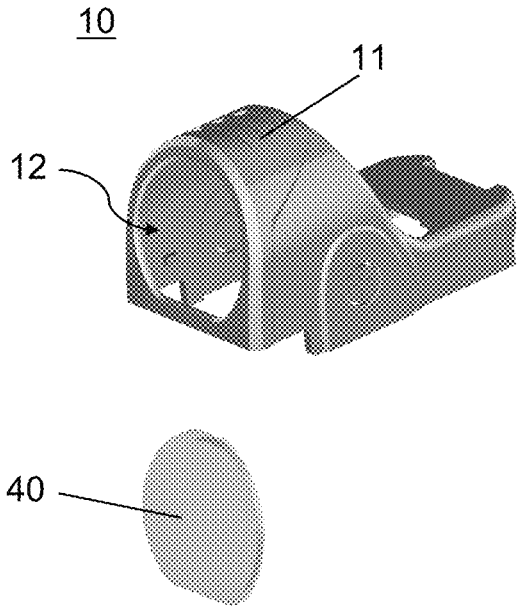
FIGS. 2A-2B are perspective views of a cover body and a lens shield of the protective cover according to an aspect of the embodiment.
Figure 2B:
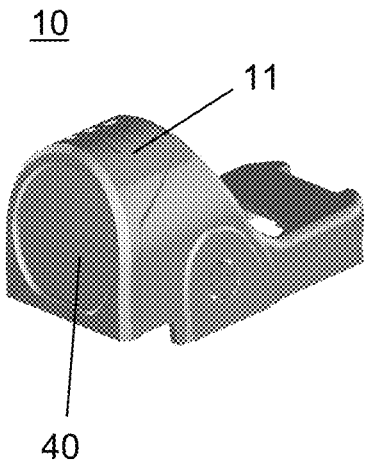

FIGS. 2A-2B generally depict perspective views of the cover body 11 with a lens shield 40 according to an aspect of the embodiment.

Referring to FIGS. 2A-2B, the cover body 11 may comprise a vision opening 12 formed on a front side of the cover body 11. In one embodiment, the cover body 10 may further comprise a lens shield 40 detachably covered on the vision opening 12. For example, the vision opening 12 may be fully covered by the lens shield 40, wherein even if the vision opening 12 is fully covered by the lens shield 40, the shooter is still able to view a red dot for aiming.

Figure 3A:
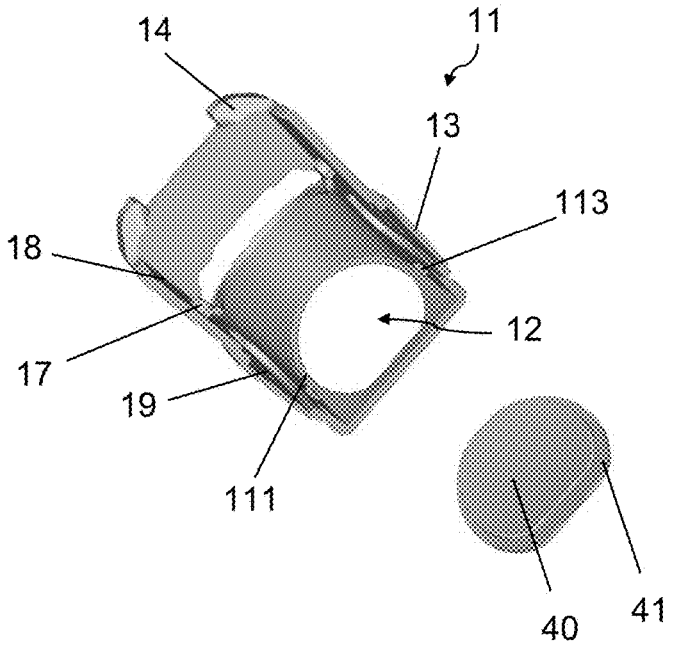
FIGS. 3A-3B are bottom views of the cover body and a lens shield of the protective cover according to an aspect of the embodiment.
Figure 3B:
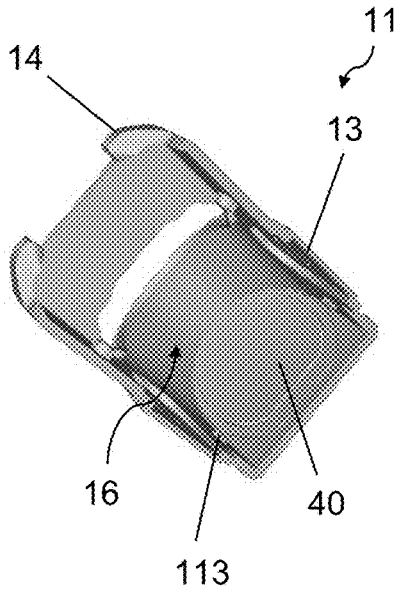

FIGS. 3A-3B generally depict views of the protective cover according to an aspect of the embodiment.

In one embodiment, the cover body 11 may further comprise a housing portion 13 dimensioned to conform with the sighting device and a base portion 14 integrally extended from the housing portion 13, wherein the base portion 14 may be configured to not only securely lock on the sighting device, but also easy to be removed from the sighting device.

Referring to FIG. 3A, the cover body 11 may be dimensioned and configured to form a housing to receive the sighting device.

As shown in further detail in FIGS. 3A-3B, the cover body 11 may comprise at least one locking unit 17 formed on an inner surface 18 of the cover body 11 and configured to lock and/or secure on the cover body 11 on the sighting device.

Referring now to the detail of FIG. 3A-3B, in some embodiments, the cover body 11 may comprise at least one locking unit 17 that protrudes from the inner surface 18 of the cover body 11 and is configured to be inserted into the sighting device. In still some embodiments, the cover body 11 may comprise locking units 17 that protrude from side surfaces of the inner surface 18 of the cover body 11.

It should be noted that in some embodiments, as shown in FIG. 3A, the cover body 11 may comprise at least one adjusting unit 19 formed on side surfaces of the cover body 11 and configured to adjust effects of the light source generated from the sighting device.

With specific reference to FIGS. 1 and. 3A-3B, the sighting device 30 may comprise at least one concave slot 32 formed at locations corresponding to locations of the locking unit 17 formed on the cover body 11, wherein the concave slot 32 may be dimensioned and configured to conform with the locking unit 17.

In some embodiments, the cover body 11 may comprise at least one adjusting unit 19 formed on side surfaces of the cover body 11, wherein the adjusting unit 19 may be configured to be covered on a portion 33 of the sighting device (as shown in FIG. 1). It should be noted that in some embodiments, the portion 33 of the sighting device 30 may be designed to adjust effects of light source generated from the sighting device 30. For example, the effects may be color, brightness, or patterns of the light source.

It should be understood that the above-described effects of the light source are exemplary and any other effects of the light source can be adopted in various embodiments of this disclosure.

Turning now to FIGS. 3A and 3B, the cover body 11 comprises a retaining track 111 being inwardly extended from the inner surface 18 of the cover body 11, wherein the retaining track 111 may form along a peripheral edge of the vision opening 12. In one embodiment, the lens shield 40 may comprise a lens peripheral edge 41 formed along a periphery of the lens shield 40. In still one embodiment, the lens peripheral edge 41 of the lens shield 40 may be biased against the retaining track 111 to retain the lens shield 40 covering on the vision opening 12. In other words, in some embodiments, the lens shield 40 may be attached on the inner surface 18 of the cover body 11 to cover the vision opening 12 of the cover body 11.

Continuing to FIGS. 3A to 3B, the cover body 11 may comprise at least one retaining unit 113 that protrudes from the inner surface 18 of the cover body 11 and is configured to be locked on the sighting device 30 (as shown in FIG. 1). In still some embodiments, the cover body 11 may comprise the retaining units 113 that protrude from the side surfaces of the inner surface 18 of the cover body 11. In such a manner, while the cover body 11 is attached to the sighting device, the retaining unit 113 may be biased against the sighting device to provide more fraction forces between the cover body 11 and the sighting device 30 (as shown in FIG. 1). Therefore, the retaining unit 113 may be configured to facilitate the cover body 11 being retained on the sighting device.

Figure 4A:
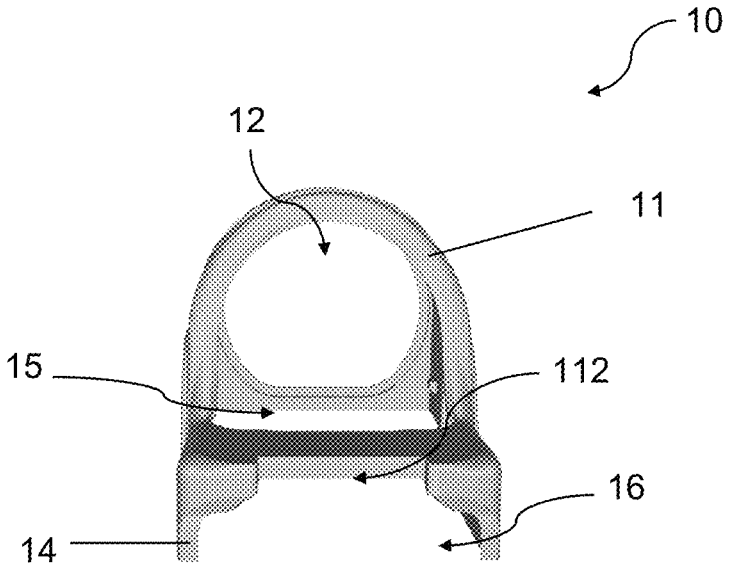
FIG. 4A is a rear view of the cover body of the protective cover according to an aspect of the embodiment.
Figure 4B:
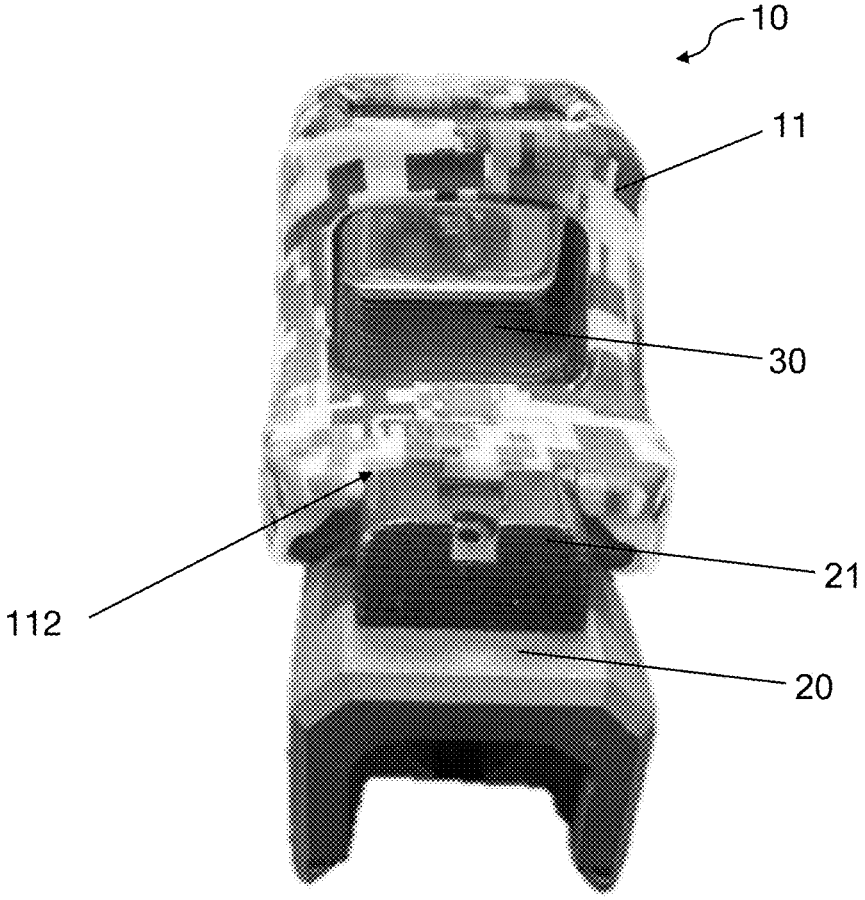
FIG. 4B is a rear view showing that the protective cover is covered on the sighting device installed on the firearm with rear side accessories according to an aspect of the embodiments.

FIG. 4A generally depicts a rear view of the cover body 11 of the protective cover 10 according to an aspect of the embodiment. FIG. 4B generally depicts a rear view of the protective cover 10 covered on the sighting device 30 according to an aspect of the embodiments.

Referring to FIG. 4A, the cover body 11 may comprise a rear vision opening 15 aligned with the vision opening 12. In one embodiment, a dimension of the rear vision opening 15 may be larger than a dimension of the vision opening 12. In still one embodiment, the dimension of the rear vision opening 15 may be smaller than the dimension of the vision opening 12. It should be noted that the dimension of the rear vision opening 15 and the dimension of the vision opening 12 may be predesigned to satisfy the needs of the shooting purpose or the styles of the sighting device.

Continuing to FIG. 4A, the cover body 11 may further comprise the rear vision opening 15 formed on a rear side of the cover body 11, wherein the front side of the cover body 11 may be opposite of the rear side of the cover body 11. In one embodiment, the cover body 11 comprises a housing opening 16 where the sighting device may be passed therethrough and the sighting device (as shown in FIG. 1) may be received inside the cover body 11.

Referring now to the details of FIG. 4A, the cover body 11 may further comprise a notch opening 112 formed on a rear portion of the cover body 11, wherein the vision opening 12 may be formed on a front portion of the cover body 11. The rear portion of the cover body 11 may be opposite of the front portion of the cover body 11. It should be noted that, the notch opening 112 may be designed to fit in with any compatible firearm rear side accessories.

In still some embodiments, the base portion 14 of the cover body 11 may be utilized to facilitate the cover body 11 being detached from the sighting device 30.

As shown in further details of FIG. 4B, while the protective cover 11 is covered on the sighting device 30 installed on the firearm 20, the notch opening 112 may be utilized to match the firearm rear side accessories 21.

Figure 5:
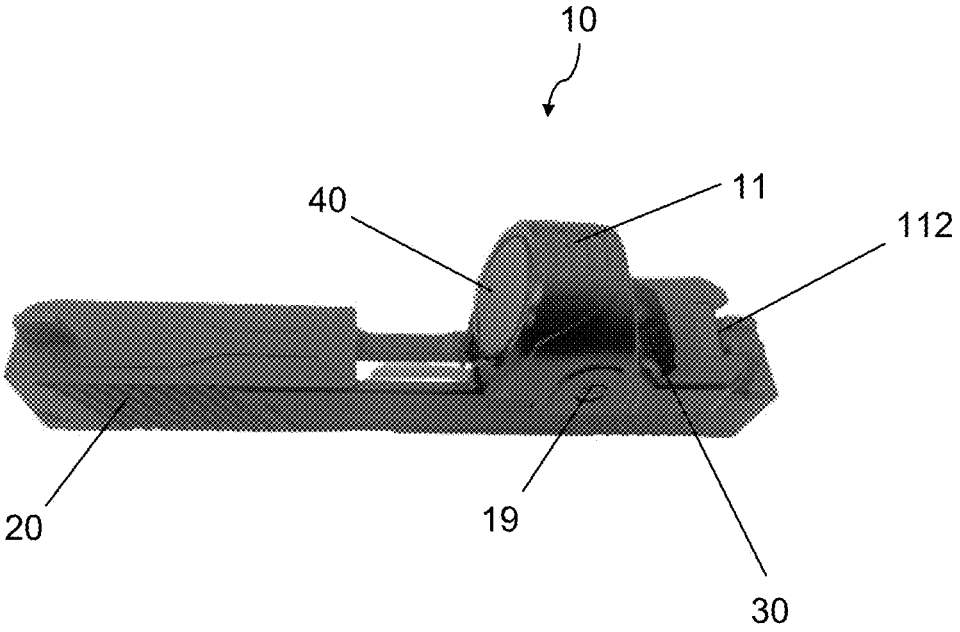
FIG. 5 is a perspective view of the protective cover showing the cover body and the lens shield covered on the sighting device according to an aspect of the embodiment.
Figure 6:
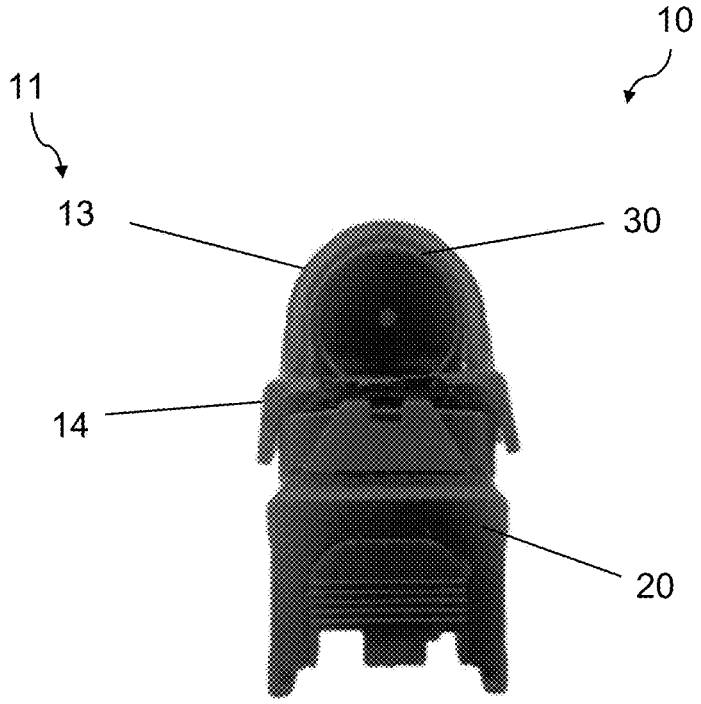
FIG. 6 is a rear view of the protective cover showing the cover body and the lens shield covered on the sighting device according to an aspect of the embodiment.

FIGS. 5-6 generally depict views of the protective cover 10 mounted on the firearm 20 according to an aspect of the embodiment.

Referring to FIGS. 5-6, in one embodiment, the housing portion 13 of the cover body 11 may be configured to cover on a top sight portion of the sighting device 30 and the base portion 14 of the cover body 11 may be covered on a bottom portion of the sighting device 30. And, in such a way, in still one embodiment, the locking unit 17 (as shown in FIGS. 3A and 3B) of the cover body 11 may be inserted into the at least one concave slot 32 (as shown in FIG. 1) formed on the sighting device 30 to affix the cover body 11 on the sighting device 30.

In one embodiment, the dimension of the cover body 11 may be dimensioned to conform with the dimension of the sighting device 30 to allow the sighting device 30 to be received inside the cover body 11. As shown in further details in FIG. 5, the lens shield 40 may comprise materials adapted to block ultraviolet lights, and in such a way, while the light source generated from the sighting device 30 is transmitted to the reflective lens 31 (as shown in FIG. 1), the light source may interfere with UV lights while the shooter fires the firearm 20. Therefore, the lens shield 40 may reduce or block the UV light interference to facilitate the shooter during firing.

It should be understood that the above-described UV lights are exemplary and any other daylights or light source can be adopted in various embodiments of this disclosure.

According to the above-mentioned embodiments, the light source generated from the sighting device 30 may be passed through the vision opening 12 (as shown in FIG. 4A), the rear vision opening 15 (as shown in FIG. 4A), and/or the reflective lens 31 (as shown in FIG. 1) and/or may further reach the lens shield 40.

Figure 7A:
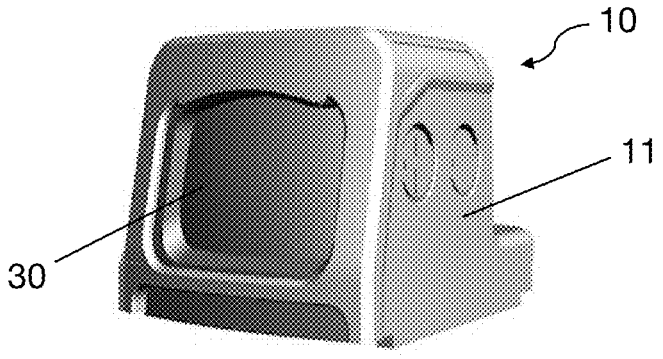
FIGS. 7A and 7B generally depict cross-sectional views of a protective cover covered on the sighting device according to another aspect of the embodiment.
Figure 7B:
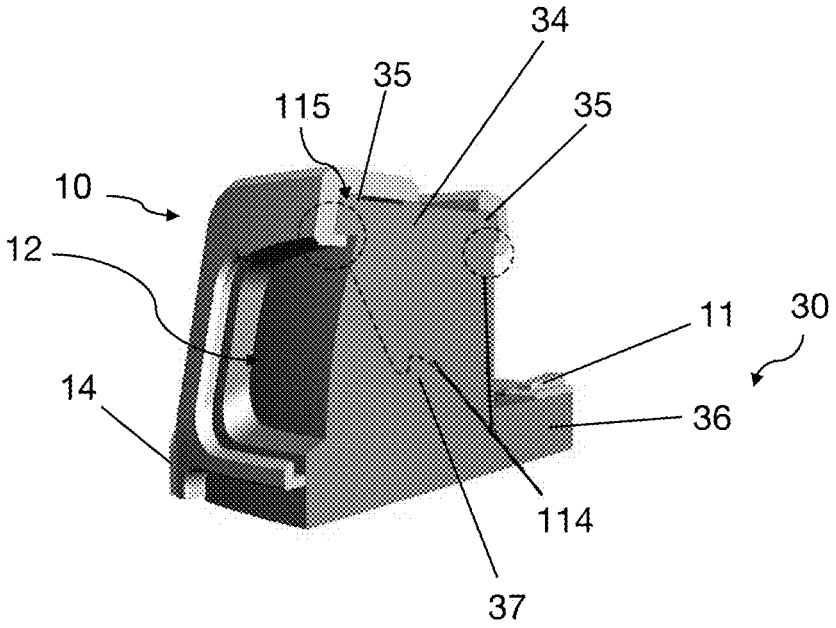

Referring to FIG. 7A and FIG. 7B, the protective cover 10 may comprise the cover body 11 configured to be couplable to the sighting device 30, wherein the sighting device 30 may comprise a top sight portion 34 and a bottom sight portion 36 integrally extended from the top sight portion 34, wherein the bottom sight portion 36 may be configured to be installed on the firearm. In some embodiments, the cover body 11 may further comprise at least one top protrusion 35 outwardly extended from the top sight portion 34 of the sighting device 30.

In some embodiments, the sighting device 30 may comprise the top sight portion 34, the bottom sight portion 36 integrally extended from the top sight portion 34 and configured to be installed on the firearm, and a middle sight portion 37 integrally formed between the top sight portion 34 and the bottom sight portion 36.

In still some embodiments, the cover body 11 may comprise a top securing unit 114 inwardly extended from an edge defined by the vision opening 12, wherein the top securing unit 114 may be inwardly extended from the edge defined by the vision opening 12 to form a receiving cavity 115, wherein the top protrusion 35 of the sighting device 30 may be engaged within the receiving cavity 115. In still some embodiments, while the cover body 11 is covered on the sighting device 30, the top securing unit 114 may be clipped on the sighting device 30, to tightly secure the cover body 11 on the sighting device 30.

Figure 8:
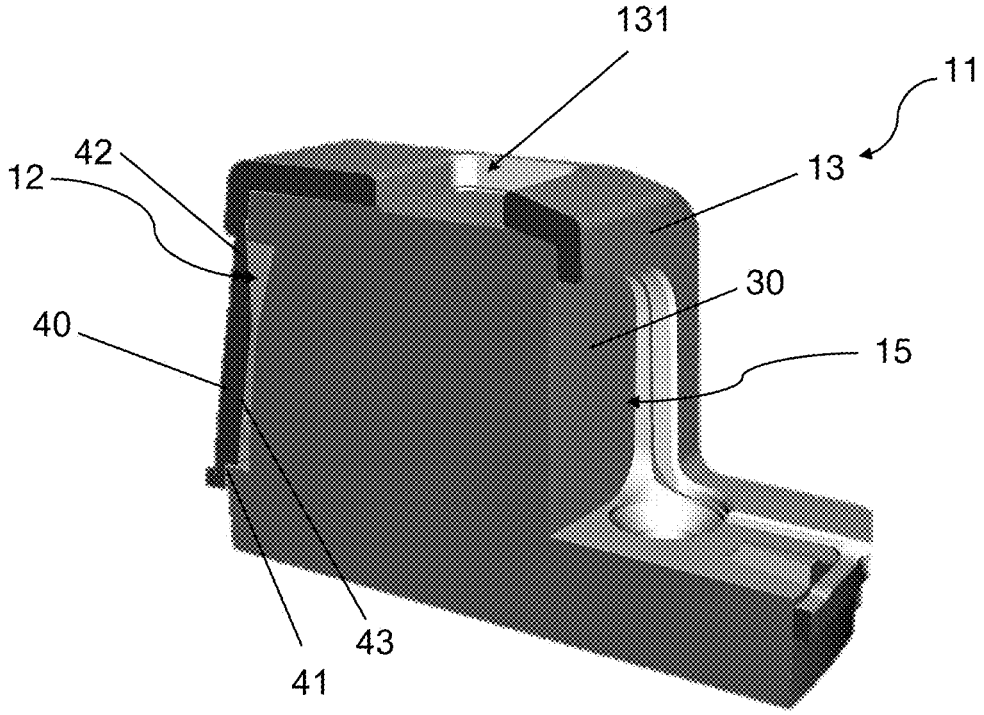
FIG. 8 is a cross-sectional view of a lens shield and the cover body according to an aspect of the embodiments.

Referring to FIG. 8, the cover body 11 comprises the vision opening 12 and the lens shield 40 being detachably covered on the vision opening 12, wherein the lens shield 40 may comprise an inclined surface 42 formed adjacent to a periphery of the lens shield 40. It should be noted that the lens shield 40 may be securely covered on the vision opening 12 by the lens peripheral edge 41, wherein the lens peripheral edge 41 may be a concave edge, and in such a way, the lens shield 40 may comprise a central protruded portion 43 downwardly extended to the periphery of the lens shield 40 to form the lens peripheral edge 41 and the inclined surface 42. In still another embodiment, the inclined surface 42 may facilitate the user to detach the lens shield 40 from the vision opening 12, and in such a way, the user may smoothly slide the lens shield 40 along the inclined surface 42.

Continuing to FIG. 8, the cover body may comprise a top opening 131 formed on a top side of a housing portion 13 of the cover body 11, and in such a way, the top opening 131 may be compatible for the sighting device 30 with solar panels.

Figure 9:
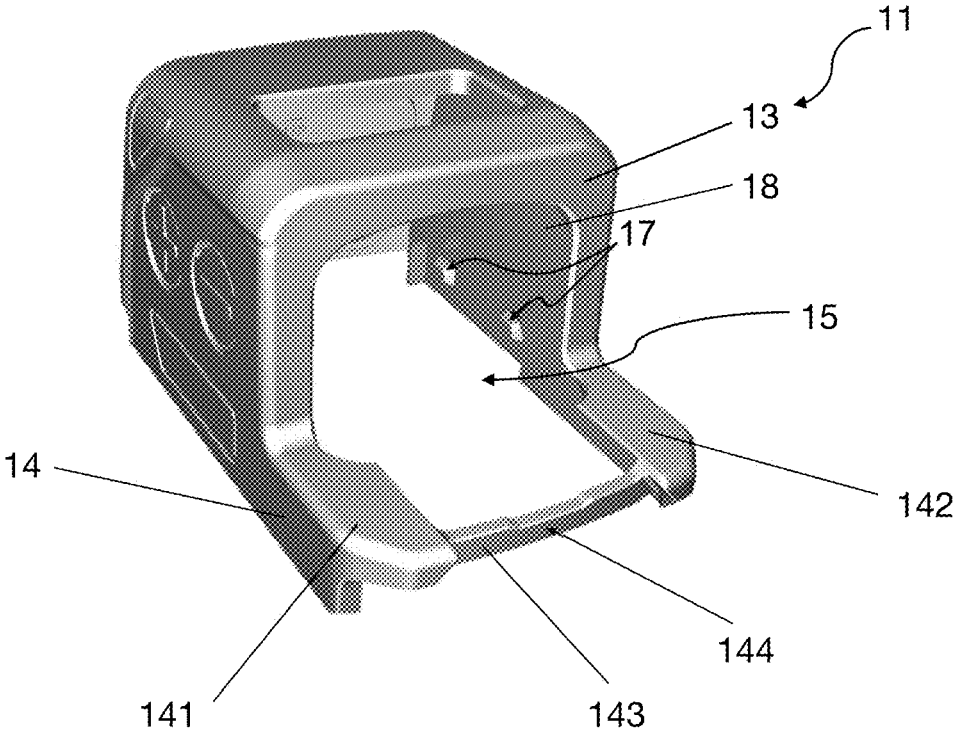
FIG. 9 is a perspective view of the cover body according to an aspect of the embodiments.

Referring to FIG. 9, the cover body 11 may comprise the rear vision opening 15 and at least one locking unit 17 (also shown in FIG. 3A to FIG. 3B) formed on an inner surface 18 of the cover body 11 and configured to lock and/or secure the cover body 11 on the sighting device.

Figure 10:
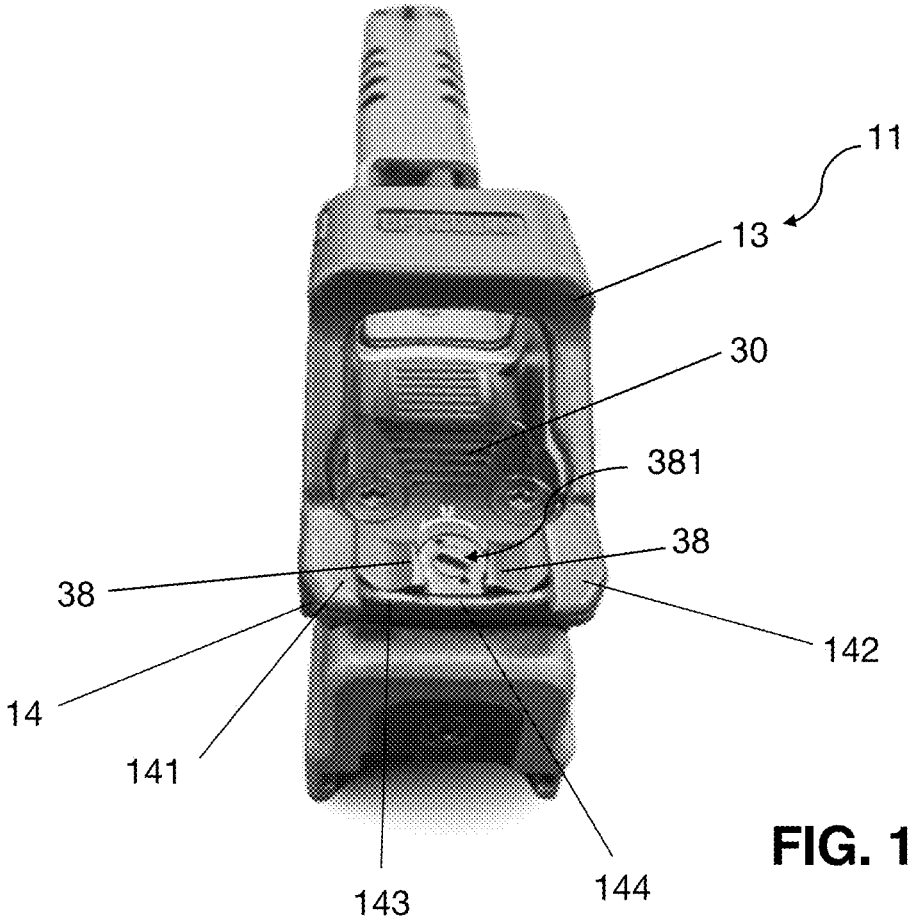
FIG. 10 is a perspective view showing that the perspective cover is secured on the sighting device according to an aspect of the embodiments.

Referring to FIG. 9 and FIG. 10, the cover body 11 may comprise the housing portion 13 dimensioned to conform with the sighting device 30, the base portion 14 having a right base portion 142 and a left base portion 141 integrally and rearwardly extended from the housing portion 13, and a middle supporting frame 143 horizontally extended and connected between the left base portion 141 and the right base portion 142 to prevent deformation of the cover body 11. In still some embodiments, the base portion 14 may further comprise a downward concave edge 144 formed on the middle supporting frame 143 for facilitating aiming. In some embodiments, the downward concave edge 144 may be indentedly formed on the middle supporting frame 143.

As shown in FIG. 10, in some embodiments, the sighting device 30 may comprise at least one rear aiming block 38, wherein each of the rear aiming blocks 38 may be spacedly arranged to form a rear aiming passway 381, and in such a manner, while the cover body 11 is covered on the sighting device 30, the downward concave edge 144 may allow the user for aiming through the rear aiming passway 381.

Figure 11:
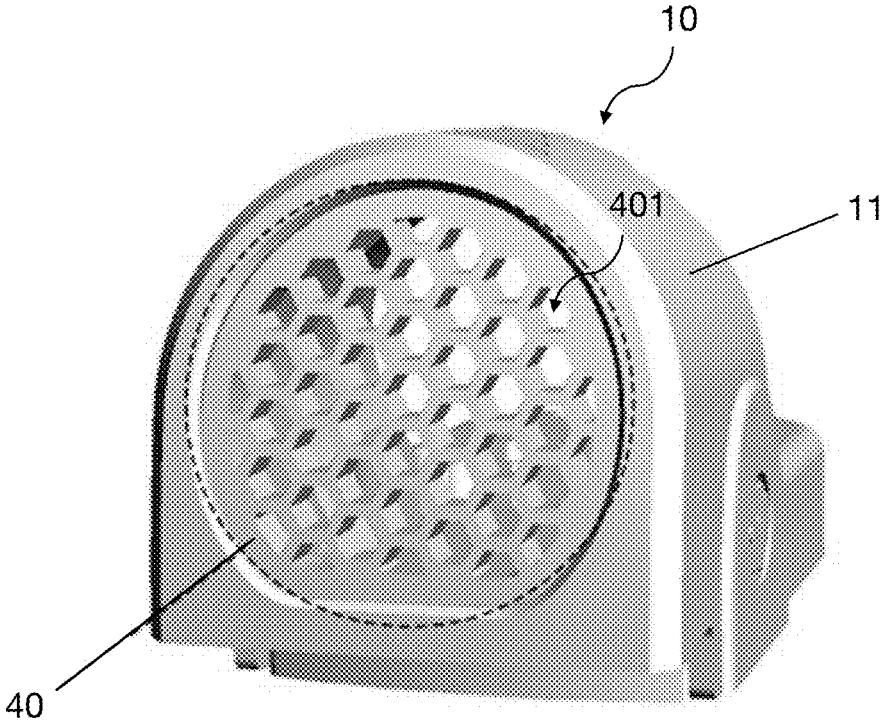
FIG. 11 is a perspective view of the protective cover showing the cover body having a lens shield with through holes according to another aspect of the embodiments.

Referring to FIG. 11, in still embodiments, the lens shield 40 may comprise a plurality of through holes 401 configured to allow the user to aim the target, and in such a manner, light reflections may be reduced by the through holes configuration of the lens shield 40. It should be noted that, in some embodiments, the through-holes configuration of the lens shield 40 may reduce the interference generated by the UV lights and also allow the user to aim at the targets.

In still some embodiments, the lens shield 40 may be attached to the inner surface of the cover body 11 to cover the vision opening of the cover body.

Figure 12:
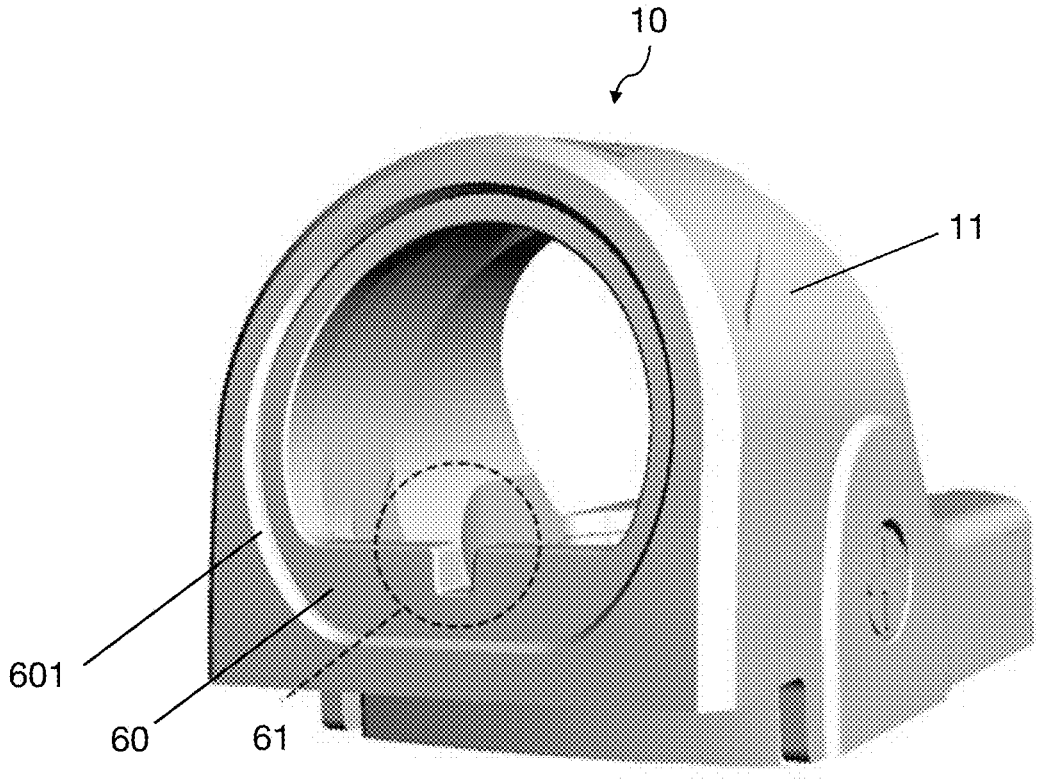
FIG. 12 is a perspective view of the protective cover showing the cover body having an aiming plate according to an aspect of the embodiments.

Referring to FIG. 12, the protective cover 10 may further an aiming plate 60 cooperated with the cover body 11, wherein the aiming plate 60 may have an aiming slot 61 configured to allow the user to aim the target.

In some embodiments, the aiming plate 60 may be arranged along an edge 601 defined by the vision opening 12 (also see FIG. 3A), wherein the edge 601 may be defined as a peripheral edge of the vision opening 12. In still some embodiments, the aiming plate 60 may be contacted with the inner surface 18 of the cover body 11.

Figure 13:
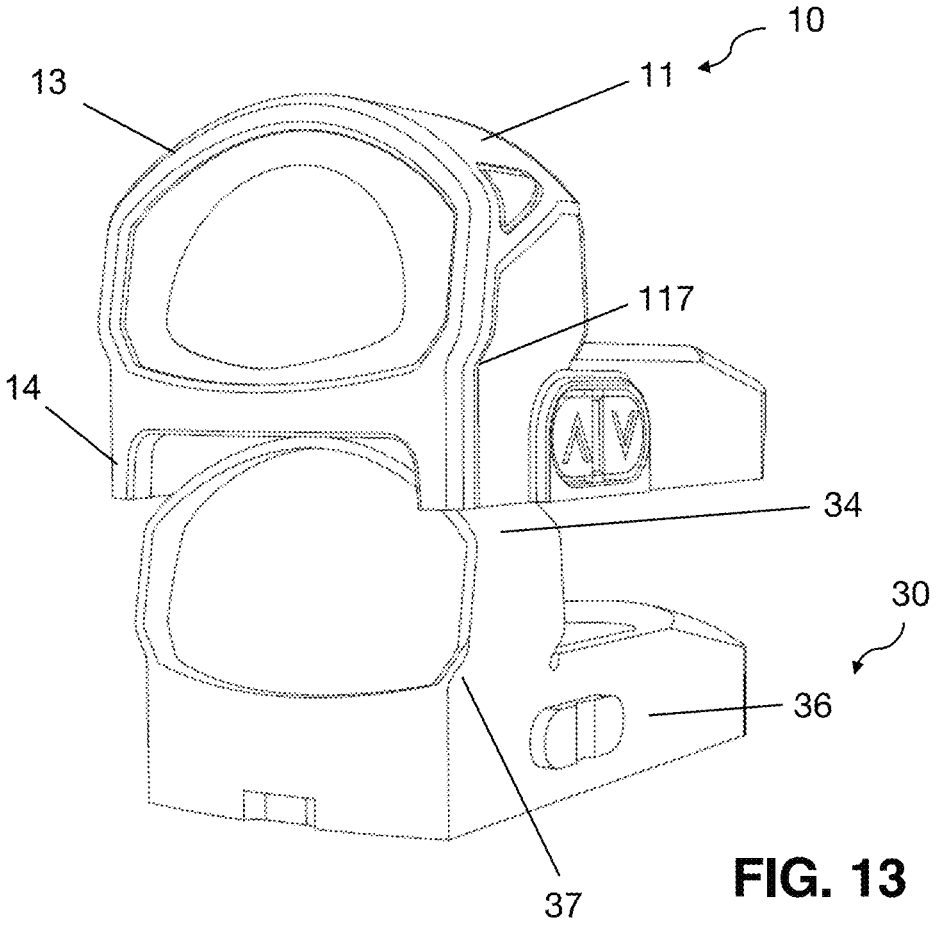
FIG. 13 is a perspective view showing the protective cover being covered on the sighting device according to still another aspect of the embodiments.

Referring to FIG. 13, in some embodiments, the cover body 11 may comprise a housing portion 13, a base portion 14, and a concave edge 117 formed between the housing portion 13 and the base portion 14.

In still some embodiments, the sighting device 30 may comprise the top sight portion 34, a bottom sight portion 36 integrally and inwardly extended from the top sight portion 34 to form a middle sight portion 37, wherein the bottom sight portion 36 may be configured to be installed on the firearm, and the middle sight portion 37 may be formed between the top sight portion 34 and the bottom sight portion 36.

Continuing to FIG. 13. in still some embodiments, the cover body 11 may further comprise a concave edge 117, wherein the base portion 14 may be outwardly extended to form the housing portion 13, and the concave edge 117 may be naturally formed between the base portion 14 and the housing portion 13.

In still some embodiments, while the cover body 11 is covered on the sighting device 30, the concave edge 117 of the cover body 11 may be locked on the middle sight portion 37 of the sighting device 30 without falling.

Figure 14:
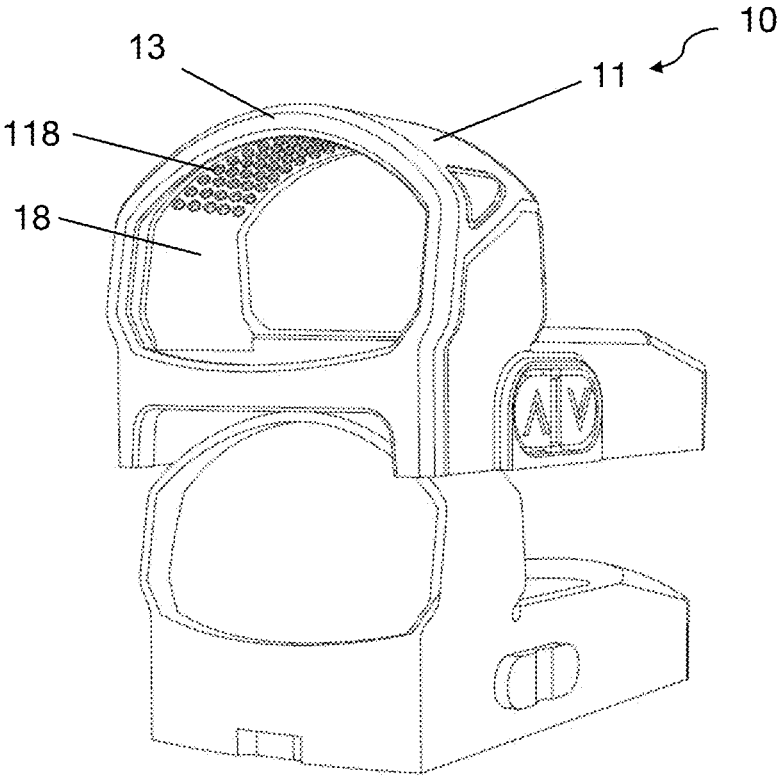
FIG. 14 is a perspective view of the protective cover showing a plurality of anti-shocking elements arranged on the cover body according to an aspect of the embodiments.

Referring to FIG. 14, in some embodiments, the cover body 11 may comprise a plurality of anti-shock elements 118 arranged on an inner surface 18 of the cover body 11. In still some embodiments, the plurality of anti-shock elements 118 may be formed on the inner surface 18 of the housing portion 13 of the cover body 11.

Figure 15:
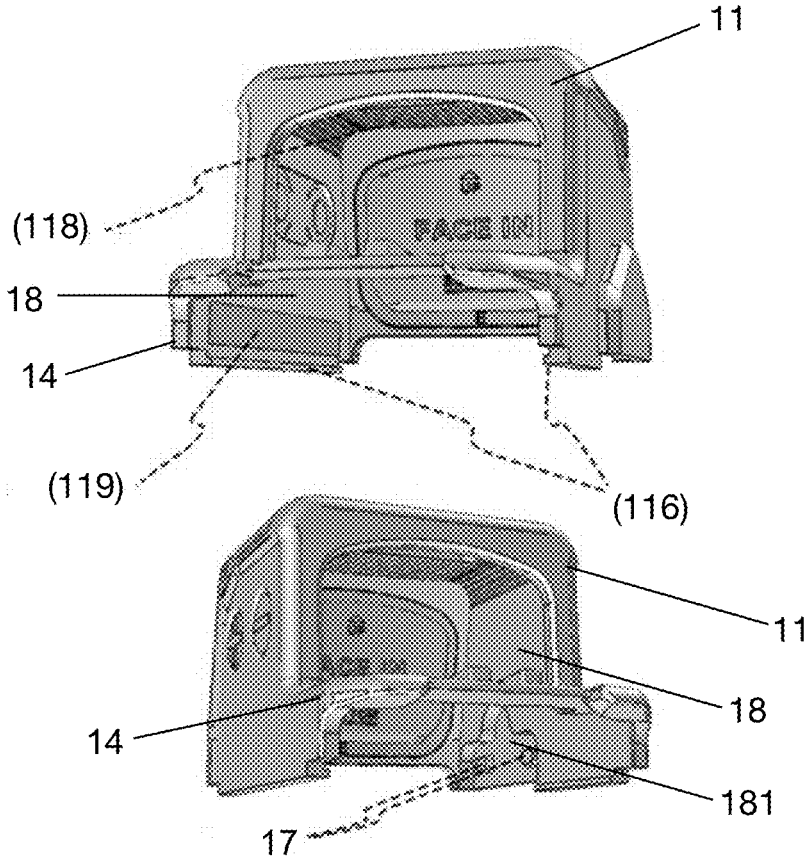
FIG. 15 is a perspective view of the protective cover showing a removable adhesive and locking units arranged on the cover body according to an aspect of the embodiments.
Figure 16:
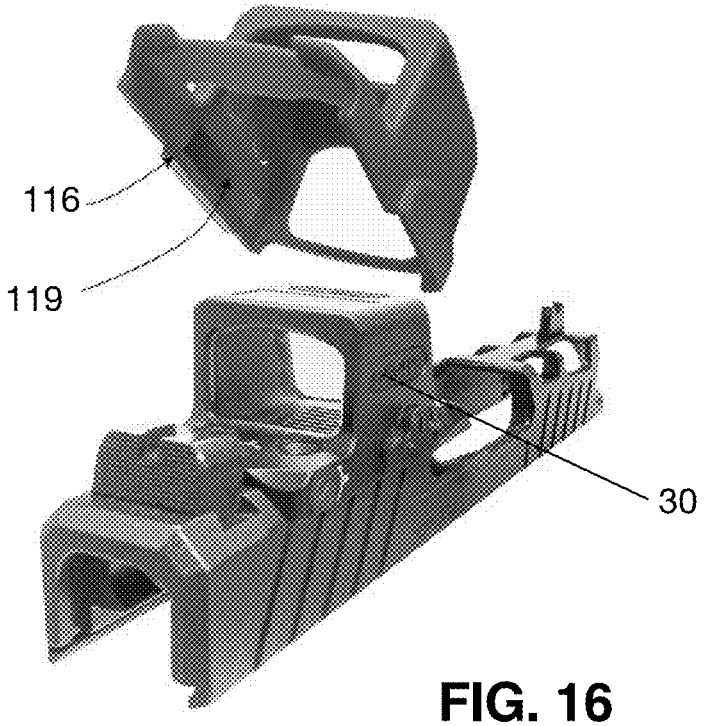
FIG. 16 is a perspective view showing the cover body attached to the sighting device according to an aspect of the embodiments.

Referring to FIGS. 15-16, in some embodiments, the cover body 11 may comprise the bottom securing unit 116 inwardly extended from the base portion 14 of the cover body 11. In still some embodiments, while the cover body 11 is covered on the sighting device 30, the bottom securing unit 116 may be clipped on the bottom sight portion of the sighting device 30, to secure the cover body 11 on the sighting device 30.

As shown in the details of FIGS. 15-16, in some embodiments, the cover body 11 may comprise a removable adhesive 119 arranged on side surfaces of the inner surface 18 of the cover body 11. It should be noted that, in some embodiments, the removable adhesive 119 may be arranged on the inner surface 18 of the base portion 14 of the cover body 11.

Figure 17:
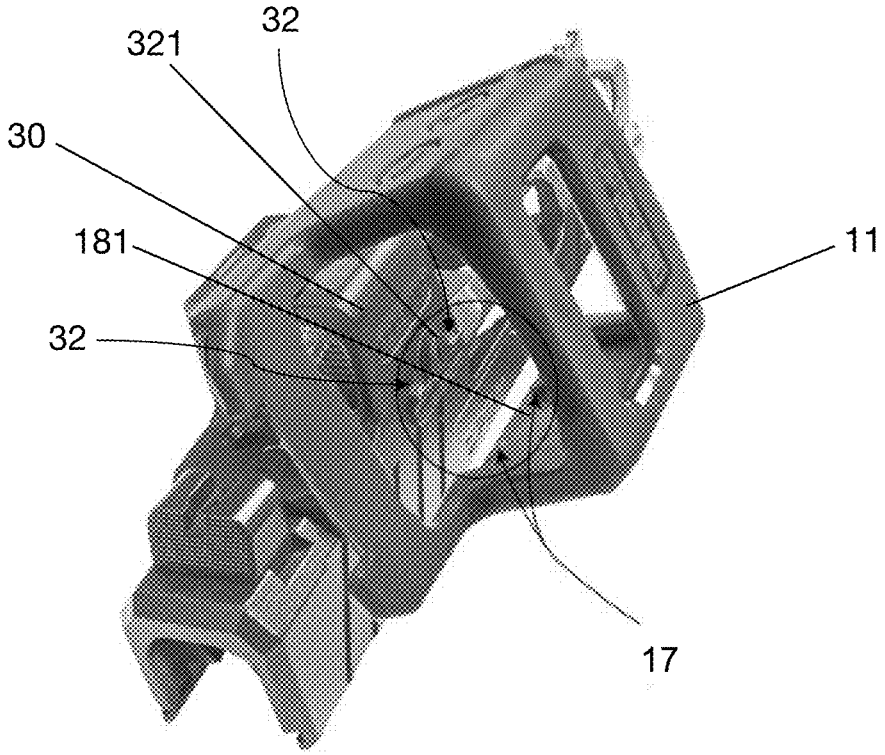
FIG. 17 is a perspective view showing the locking units engaged with the concave slot according to an aspect of the embodiments.

Referring to FIG. 15 and FIG. 17, in some embodiments, the cover body 11 may comprise a recess surface 181 concavely formed on the inner surface 18 of the base portion 14 of the cover body 11. In still some embodiments, the cover body 11 may comprise at least one locking unit 17 formed on the recess surface 181, and in other words, the locking unit 17 may be formed on the inner surface 18 of the base portion 14 of the cover body 11, wherein the locking units 17 may be upwardly protruded from the recess surface 181. It should be noted that the recess surface 181 is inwardly extended from the inner surface 18 to form a concave surface.

In still some embodiments, while the cover body 11 is covered on the sighting device, the locking units 17 may be inserted into the sighting device 30 or the locking units 17 may be clipped on the sighting device 30.

In still some embodiments, while the cover body 11 is covered on the sighting device 30, the locking units 17 may be engaged with the concave slots 32 formed on the sighting device 30. For one example, the concave slots 32 may be formed on side surfaces of the sighting device 30, wherein concave slots 32 may be naturally formed above a side protrusion 321 arranged on the side surfaces of the sighting device 30, and in such a manner, the locking units 17 may be engaged with the slots 32 to secure the cover body 11 on the sighting device 30.

Figure 18:
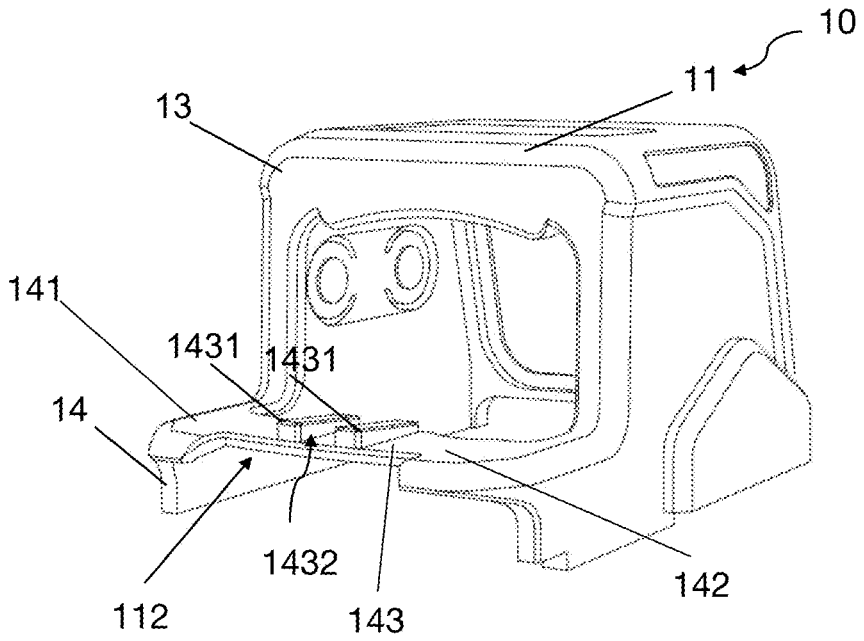
FIG. 18 is a perspective view of the protective cover showing aiming blocks arranged on the cover body according to an aspect of the embodiments.

Referring to FIG. 18, the cover body 11 may comprise at least one aiming block 1431 formed on the base portion 14 of the cover body 11. In some embodiments, each of the aiming blocks 1431 may be spacedly arranged to form an aiming slot 1432, wherein the aiming slot 1432 may facilitate the user for aiming the targets.

In some embodiments, the aiming blocks 1431 may be formed on the middle supporting frame 143, wherein the aiming blocks may be formed between the right base portion 142 and the left base portion 141.

Figure 19:
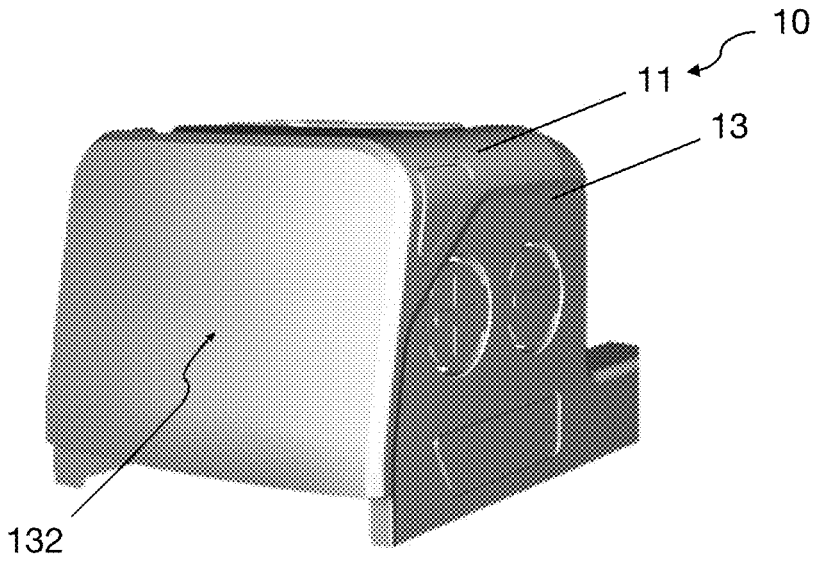
FIG. 19 is a perspective view of a one-piece cover body according to an aspect of the embodiments.

Referring to FIG. 19, the cover body 11 may comprise the housing portion 13, and a front portion 132 integrally extended from the housing portion 13 to form a one-piece configuration.

FIGS. 20A-21B generally depicts a protective cover for a device, such as a sighting device or a scope device, according to an aspect of another embodiment.

Figure 20A:
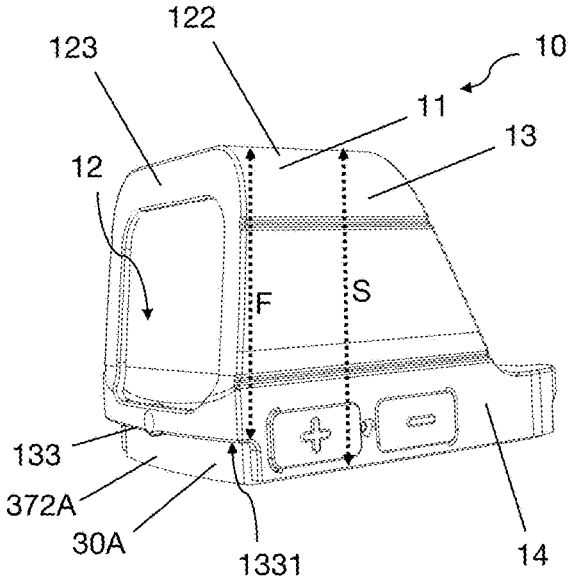
FIGS. 20A-20B are perspective views of a protective cover covered on a device according to an aspect of the embodiments.
Figure 20B:
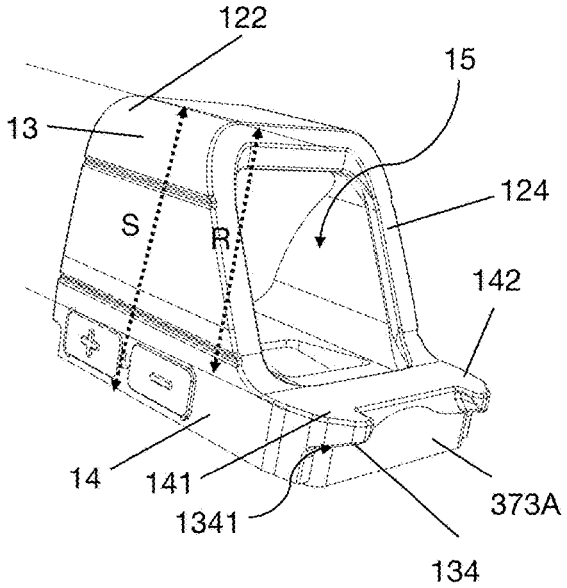

Referring to FIGS. 20A to 20B, in some embodiments, a protective cover 10 for a device 30A installed on a firearm may comprise a cover body 11 having a housing portion 13 and a base portion 14 integrally extended from the housing portion 13. The housing portion 13 may be configured to be compatible with the device 30A and to cover it.

Figure 21A:
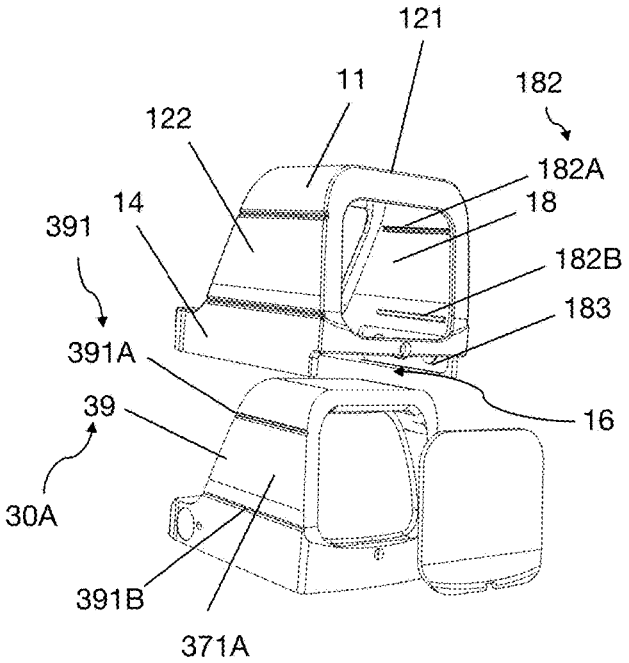
FIGS. 21A-21B are exploded views of the protective cover covered on the device of FIGS. 20A-20B.
Figure 21B:
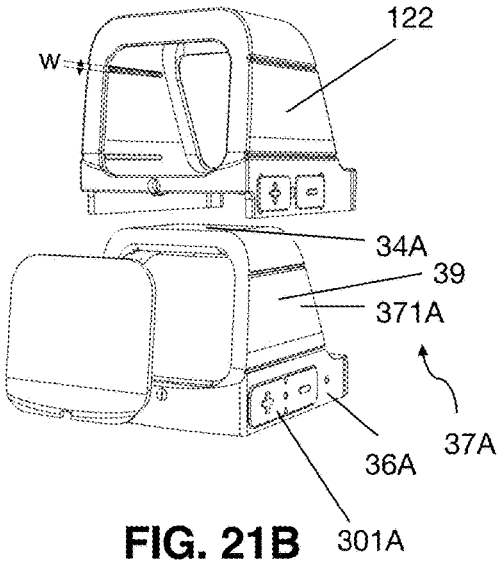
Figure 22A:
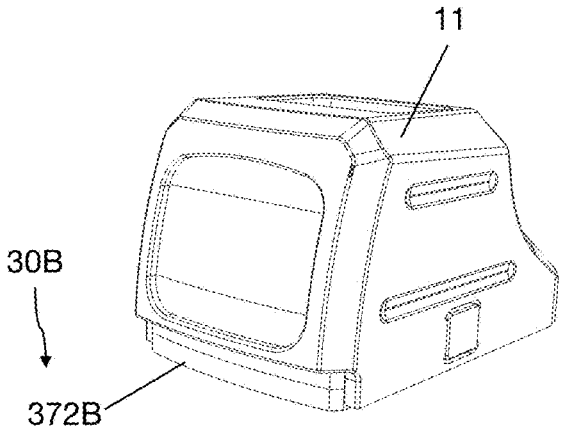
FIGS. 22A-22B are perspective views of the protective cover covered on the device according to an aspect of another embodiment.
Figure 22B:
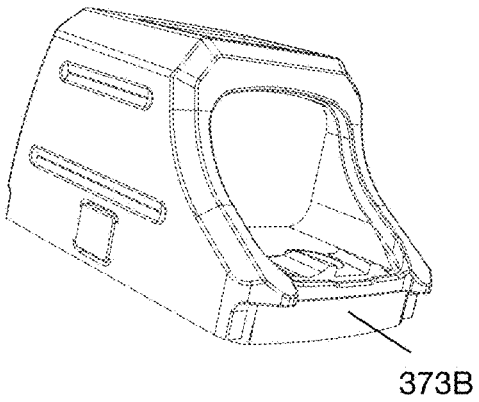
Figure 23A:
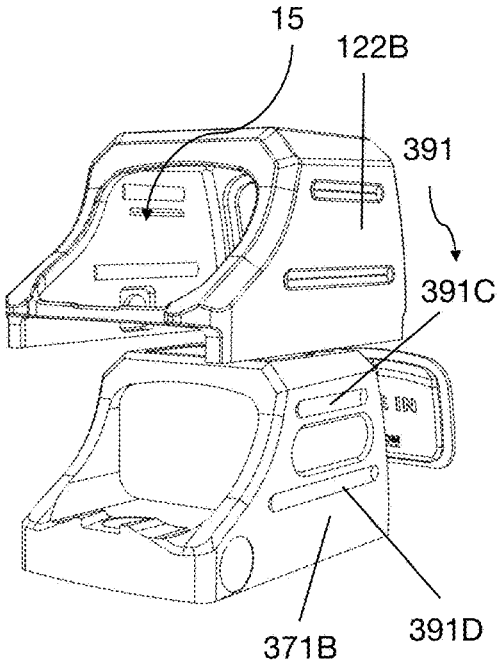
FIGS. 23A-23B are exploded views of the protective cover covered on a device of FIGS. 22A-22B.
Figure 23B:
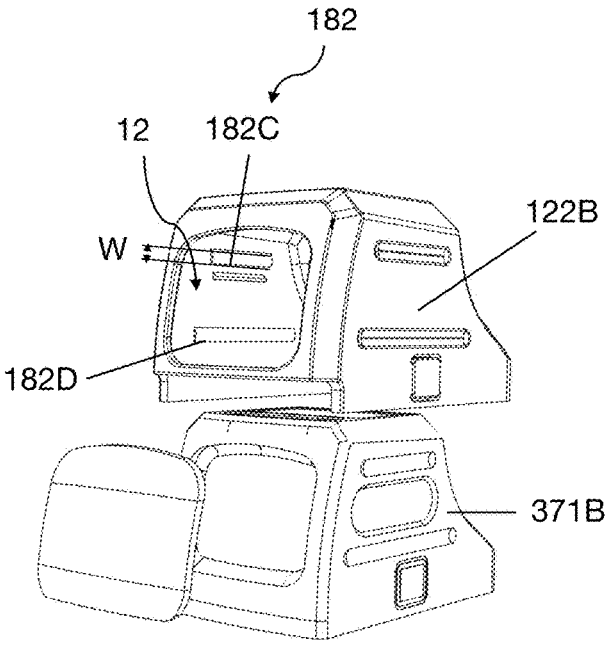
Figure 24A:
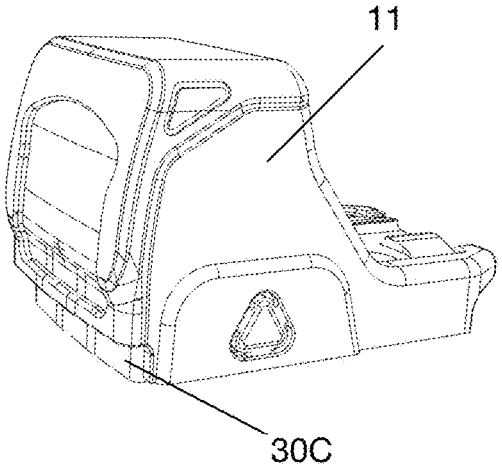
FIGS. 24A-24B are perspective views of the protective cover covered on a device according to an aspect of still another embodiment.
Figure 24B:
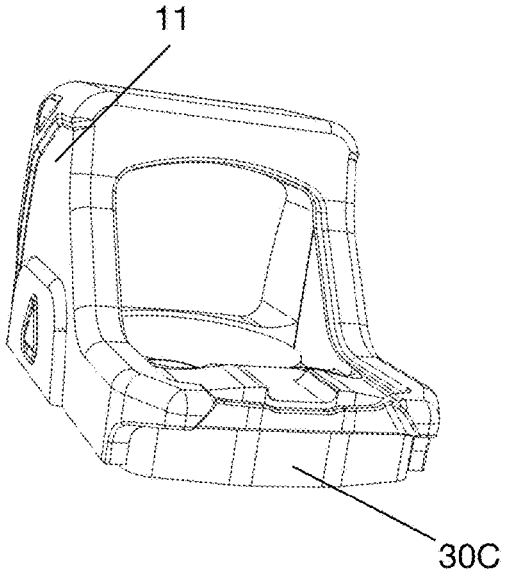
Figure 25A:
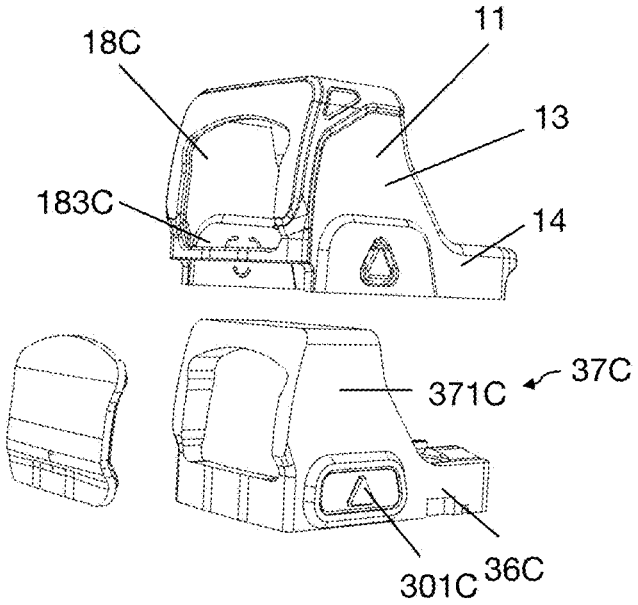
FIGS. 25A-25B are exploded views of the protective cover covered on a device of FIGS. 24A-24B.
Figure 25B:
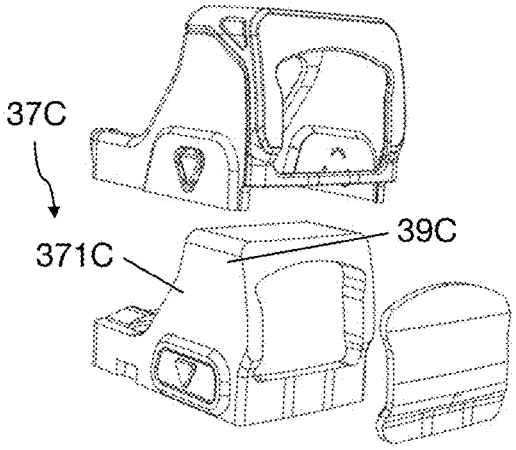
Figure 26A:
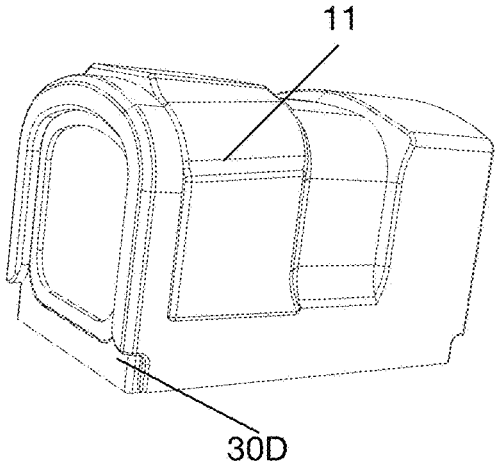
FIGS. 26A-26B are perspective views of the protective cover covered on the device according to an aspect of still another embodiment.
Figure 26B:
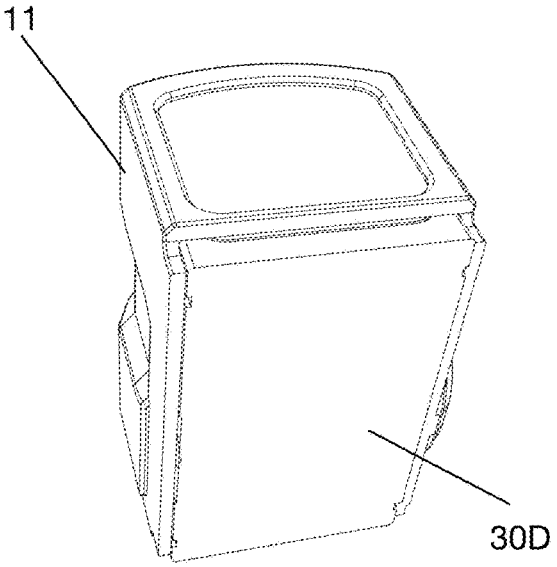
Figure 27A:
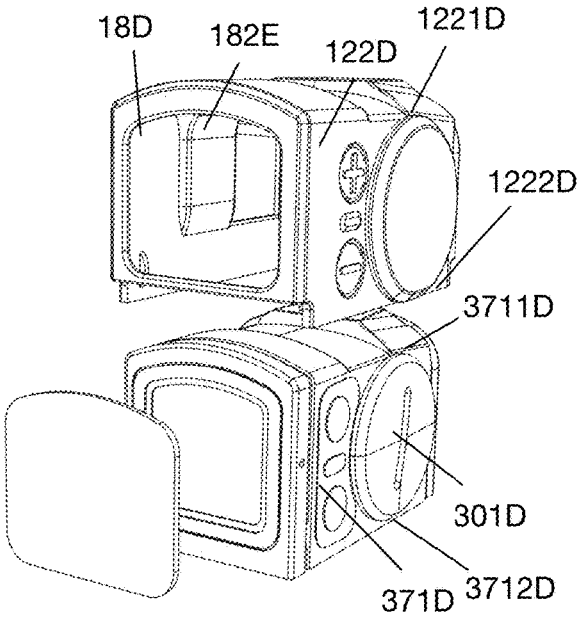
FIGS. 27A-27B are exploded views of the protective cover covered on the device of FIGS. 26A-26B.
Figure 27B:
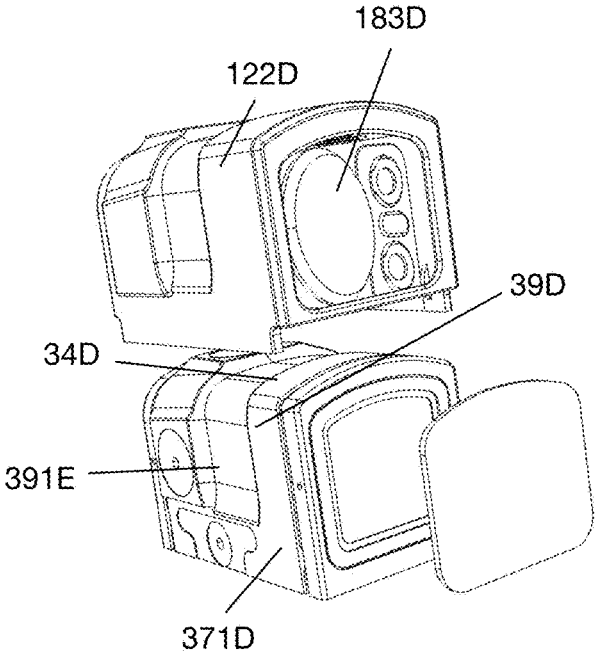

Referring to FIGS. 21A and 21B, in still some embodiments, the cover body 11 may comprise an inner surface 18 having at least one securing protrusion 182 configured to match with an outer surface 39 of the device 30A to tightly secure the cover body 11 on the device 30A.

In still some embodiments, the outer surface 39 of the device 30A comprises at least one indented slot 391, wherein each indented slot 391 corresponds to each of the at least one securing protrusion 182.

It should be noted that at least one securing protrusion 182 may be inserted into each of the indented slots 391 to tightly secure the cover body 11 on the device 30A. In other words, the cover body 11 may be configured to cover at least 90 percent of the outer surface 39 of the device 30A to protect it without exposing it to the outside.

Referring to further details in FIGS. 20A to 21B, in some embodiments, each of the at least one indented slot 391 may be inwardly and integrally extended from the outer surface 39 of the device 30A, and each of the at least one securing protrusion 182 may be upwardly and integrally extended from the inner surface 18 of one of two cover side walls 122 to a top cover wall 121 integrally extended from the two cover side walls 122.

In still some embodiments, the cover body 11 may comprise two cover side walls 122 integrally extended from a top cover wall 121, wherein one of the two cover side walls 122 may be arranged on an opposite side of the other one of the two cover side walls 122.

Continuing to FIG. 21A and FIG. 21B, the at least one securing protrusion 182 comprises a first securing protrusion 182A and a second securing protrusion 182B parallelly arranged with the first securing protrusion 182A, wherein the first securing protrusion 182A may be arranged adjacent to the top cover wall 121 and the second securing protrusion 182B may be arranged adjacent to the base portion 14.

In still some embodiments, the device 30A may comprise a top portion 34A, a bottom portion 36A integrally extended from the top portion 34A and configured to be installed on the firearm, and a middle portion 37A formed between the top portion 34A and the bottom portion 37A, wherein the middle portion 37A comprises two side walls 371A where the at least one indented slot 391 are formed thereon. In still some embodiments, one of the two side walls 371A may be formed on an opposite side of the other one of the two side walls 371A.

In still some embodiments, wherein the outer surface 39 of the device 30A may comprise a first indented slot 391A and a second indented slot 391B parallelly arranged with the first indented slot 371A, wherein the first indented slot 371A may be arranged adjacent to the top portion 34A of the device 30A and the second indented slot 391B may be arranged adjacent to the bottom portion 36A of the device 30A.

In some embodiments, while the cover body 11 is covered on the device 30A, the first securing protrusion 182A is inserted into the first indented slot 391A, and the second securing protrusion 182B is inserted into the second indented slot 391B, so as to secure the cover body 11 tightly to the device 30A.

In still some embodiments, each at least one securing protrusion 182, including the first securing protrusion 182A and the second securing protrusion 182B, may be upwardly and integrally extended from the inner surface 18 of the cover body 11.

In still some embodiments, the base portion 14 may comprise a right base portion 142 and a left base portion 141 integrally and horizontally extended from the base portion 14, wherein the housing portion 13 may comprise two cover side walls 122 and the at least one securing protrusion 182 which are formed on the inner surface 18 of the two cover side walls 122.

In still some embodiments, the cover body 11 may comprise an indented cavity 183 formed on the base portion 13 of the cover body 11, wherein the indented cavity 183 is inwardly extended from the inner surface 18 of the cover body 11 and configured to match with the outer surface 39 of the device 30A.

In still some embodiments, the device 30A may comprise a button 301A outwardly extended from the outer surface 39 of the bottom portion 36A of the device 30A, wherein the button 301A is inserted into the indented cavity 183.

In still some embodiments, the housing portion 13 may comprise two cover side walls 122, a front cover wall 123 integrally extended from the two cover side walls 122, and a rear cover wall 124 integrally extended from the two cover side walls 122 to form a sloped wall, wherein each of the two cover side walls 122 comprises a cover side wall height "S" which is longer than a front cover wall height "F" defined by the front cover wall 123, wherein each of the two cover side walls 122 comprises the cover side wall height "S" which is longer than a rear cover wall height "R" defined by the rear cover wall 124.

It should be noted that, in some embodiments, the cover body 11 may comprise a vision opening 12 formed on the front cover wall 123 and a rear vision opening 15 formed on the rear cover wall 124, wherein the vision opening 12 may be formed on an opposite side of the rear vision opening 15.

In still some embodiments, the housing portion 13 may comprise a front bottom edge 133 rearwardly and indentedly extended towards the rear vision opening 15 to form a front indented contour 1331, wherein the housing portion 13 may comprise a rear bottom edge 134 frontward and indentedly extended towards the vision opening 12 to form a rear indented contour 1341, and in such a way, while the cover body 11 is attached on the device 30A, a partial part of a front wall 372A of the device 30A may be exposed outside, and in such a way, a partial part of a rear wall 373A of the device 30A may be exposed outside; therefore, it facilitates the user detaching the cover body 11 from the device 30A through the front indented contour 1331 and the rear indented contour 1341.

In still some embodiments, the cover body 11 may comprise a housing opening 16 where the device 30A is passed through to cover the device 30A and the rear vision opening 15 where a light source generated from the device 30A is passed through, wherein the at least one securing protrusion 182, including the first securing protrusion 182A and the second securing protrusion 182B, is integrally and horizontally extended from the vision opening 12 to the rear vision opening 15, and in other words, the at least one securing protrusion 182, including the first securing protrusion 182A and the second securing protrusion 182B, may be horizontally extended across the entire cover side walls 122 (the two cover side walls 122).

In still some embodiments, the at least one indented slot 391, including the first indented slot 391A and the second indented slot 391B, may be horizontally extended across the entire side wall 371A (the two side walls 371A), which is extended from the front wall 372A towards the rear wall 373A, corresponding to the locations of the first securing protrusion 182A and the second securing protrusion 182B.

FIGS. 22A-23B generally depict the protective cover for a device, such as a sighting or scope device, according to an aspect of another embodiment.

Referring to FIGS. 22A-23B, almost all the features of the cover body 11 and the device 30B are the same as those of the cover body 11 and the device 30A, as shown in FIGS. 20A-21B, except for at least one indented slot 391, including the first indented slot 391C and the second indented slot 391D, and the at least one securing protrusion 182, including the first securing protrusion 182C and the second securing protrusion 182D.

As shown in further detail in FIGS. 22A-23B, the at least one securing protrusion 182, including the first securing protrusion 182C and the second securing protrusion 182D, is integrally and horizontally extended from the vision opening 12 to the rear vision opening 15; however, the at least one securing protrusion 182, including the first securing protrusion 182C and the second securing protrusion 182D, is not horizontally extended across the entire cover side walls 122B (the two cover side walls 122B).

Accordingly, at least one indented slot 391, including the first indented slot 391C and the second indented slot 391D, may not be horizontally extended across the entire side wall 371B (the two side walls 371B), which extends from the front wall 372B to the rear wall 373B, corresponding to the locations of the first securing protrusion 182C and the second securing protrusion 182D.

Continuing to FIGS. 22A-23B, in some embodiments, according to the features of the at least one securing protrusion 182, including the first securing protrusion 182C and the second securing protrusion 182D and the at least one indented slot 391, including the first indented slot 391C and the second indented slot 391D, the widths "W" of the at least one securing protrusion 182, including the first securing protrusion 182C and the second securing protrusion 182D, may be larger than widths "w" of the at least one securing protrusion 182, including the first securing protrusion 182A and the second securing protrusion 182B, as shown in FIGS. 20A-21B, to achieve the function.

FIGS. 24A-25B generally depicts the protective cover for the device 30C, such as the sighting device or the scope device, according to an aspect of still another embodiments.

Referring to FIGS. 24A-25B, almost all the features of the cover body 11 and the device 30C are the same as those of the cover body 11 and the device 30A, 30B, as shown in FIGS. 20A-23B, except for the at least one indented slot 391, the at least one securing protrusion 182, the indented cavity 183C of the cover body 11 and the button 301C of the device 30C, wherein there are no at least one indented slot 391 and the at least one securing protrusion 182, as discussed from FIGS. 20A-23B, arranged on the cover body 11.

In some embodiments, as shown in FIGS. 24A-25B, the button 301C of the device 30C is outwardly extended from the outer surface 39C of the device 30C, wherein the button 301C is formed on the bottom portion 36C and the middle portion 37C of the device 30C, and in such a way, the cover body 11 may comprise the indented cavity 183C formed on the base portion 14 and the housing portion 13 of the cover body 11, wherein the indented cavity 183C is inwardly extended from the inner surface 18C of the cover body 11 and configured to match with the outer surface 39C of the device 30C, wherein the button 301C may be integrally extended from the bottom portion 36C to the middle portion 37C of the device 30C, wherein the indented cavity 183C may be integrally extended from the base portion 14 to the housing portion 13 of the cover body 11, and in such a way, the function of the button 301C and the indented cavity 183C can be functioned as a function of the at least one indented slot 391 and the at least one securing protrusion 182, as discussed from FIGS. 20A-23B, to achieve the intended purpose of the invention.

In still some embodiments, the button 301C may outwardly extend from the outer surface 39C of the bottom portion 36C to the middle portion 37C of the device 30C, wherein the button 301C is inserted into the indented cavity 183C, wherein in such a way, an area of the button 301C, as shown in FIGS. 24A-25B may be larger than an area of the button 301A, as shown in FIGS. 20A-21B to achieve the intended purpose of the invention.

FIGS. 26A-27B generally depict the protective cover for a device, such as a sighting or scope device, according to an aspect of another embodiment.

Referring to FIGS. 26A-27B, almost all the features of the cover body 11 and the device 30D are the same as those of the cover body 11 and the devices 30A, 30B, and 30C, as shown in FIGS. 20A-25B, except for the indented cavity 183D of the cover body 11 and the button 301D of the device 30D.

In some embodiments, the cover body 11 may comprise a securing protrusion 182E transversely and integrally extended from one of the inner surface 18D of the two cover side walls 122D, wherein the device 30D may comprise an indented slot 391E transversely and integrally extended from the outer surface 39D of one of two side walls 371D of the device 30D to the top portion 34D of the device 30D. In this way, the button 301D may be arranged on the other side walls 371D of the device 30D.

In still some embodiments, an area of the button 301D, as shown in FIGS. 26A-27B may be larger than the area of the button 301, 301A, and 301B, as shown in FIGS. 20A-25B to achieve the intended purpose of the invention, wherein the button 301D may be extended from a top edge 3711D of the one of the two side walls 371D until a bottom edge 3712D of the one of the two side walls 371D, and in other words, the area of the button 301D may occupy at least fifty percents of one of the two side walls 371D, wherein the cover body 11 may comprise the indented cavity 183D extended from a top cover side wall edge 1221D to a bottom cover side wall edge 1222D, and in such a way, the indented cavity 183D may occupy at least fifty percents of one of the two cover side walls 122D to achieve the intended purposes of the cover body 11 and the device 30A, 30B, 30C, as shown in FIGS. 20A-25B.

Many alterations and modifications may be made by those having ordinary skill in the art without departing from the spirit and scope of the disclosed embodiments. Therefore, it must be understood that the illustrated embodiments have been set forth only for the purposes of example and that it should not be taken as limiting the embodiments as defined by the following claims. For example, even though the elements of a claim are set forth below in a certain combination, it must be expressly understood that the embodiment includes other combinations of fewer, more, or different elements disclosed herein even when not initially claimed in such combinations.

Thus, specific embodiments and applications of the protective cover have been disclosed. It should be apparent, however, to those skilled in the art that many more modifications besides those already described are possible without departing from the disclosed concepts herein. Therefore, the disclosed embodiments are not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Insubstantial changes from the claimed subject matter as viewed by a person with ordinary skill in the art, now known or later devised, are expressly contemplated as being equivalent within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be obviously substituted and also what essentially incorporates the essential idea of the embodiments. In addition, where the specification and claims refer to at least one of something selected from the group consisting of A, B, C . . . and N, the text should be interpreted as requiring at least one element from the group which includes N, not A plus N, or B plus N, etc.

The words used in this specification to describe the various embodiments are to be understood not only in the sense of their commonly defined meanings but to include by special definition in this specification structure, material, or acts beyond the scope of the commonly defined meanings. Thus, if an element can be understood in the context of this specification as including more than one meaning, then its use in a claim must be understood as being generic to all possible meanings supported by the specification and by the word itself.

The definitions of the words or elements of the following claims therefore include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

What is claimed is:

1. A protective cover for a device installed on a firearm, comprising:

a cover body having a housing portion and a base portion integrally and inwardly extended from the housing portion and a concave edge naturally and integrally formed between the housing portion and the base portion; wherein the cover body comprises an inner surface configured to be engaged with the sighting device, wherein the inner surface comprises at least one securing protrusion upwardly and integrally extended from the inner surface and configured to match with an outer surface of the device for tightly securing the cover body on the device; and the cover body defines an interior space and the at least one securing protrusion is disposed within the interior space; wherein the cover body comprises an indented cavity formed on the base portion of the cover body, wherein the indented cavity is inwardly extended from the inner surface of the cover body and configured to match with a button outwardly extended from an outer surface of the device, wherein the button is inserted into the indented cavity.

2. The protective cover of claim 1, the outer surface of the device comprises at least one indented slot, wherein each of the indented slots corresponds to each of the at least one securing protrusion.

3. The protective cover of claim 1, wherein each of the at least one securing protrusion is horizontally extended across an entire surface of one or both of two cover side walls of the cover body.

4. The protective cover of claim 1, wherein the outer surface of the device comprises at least one indented slot, wherein each of the at least one securing protrusion is inserted into each of the indented slots, wherein each of the at least one indented slot is inwardly and horizontally extended on the outer surface of the device.

5. The protective cover of claim 1, wherein the at least one securing protrusion comprises a first securing protrusion and a second securing protrusion parallelly arranged with the first securing protrusion, wherein the first securing protrusion is arranged adjacent to a top cover wall of the cover body and the second securing protrusion is arranged adjacent to the base portion of the cover body.

6. The protective cover of claim 1, wherein the outer surface of the device comprises a first indented slot and a second indented slot parallelly arranged with the first indented slot, wherein the first indented slot is arranged adjacent to a top portion of the device and the second indented slot is arranged adjacent to a bottom portion of the device.

7. The protective cover of claim 1, wherein the cover body comprises a vision opening formed on a front cover wall of the cover body and a rear vision opening formed on a rear cover wall of the cover, wherein the front cover wall is arranged on an opposite side of the rear cover wall.

8. The protective cover of claim 2, wherein the device comprises a top portion, a bottom portion integrally extended from the top portion and configured to be installed on the firearm, and a middle portion formed between the top portion and the bottom portion, wherein the middle portion comprises two side walls where the at least one indented slot are formed thereon.

9. The protective cover of claim 1, wherein the base portion comprises a right base portion and a left base portion integrally and transversely extended from the right base portion, wherein the housing portion comprises two cover side walls and the at least one securing protrusion are formed on the inner surface of the two cover side walls.

10. The protective cover of claim 2, wherein the at least one indented slot is horizontally extended across an entire surface of a side wall of the device.

11. The protective cover of claim 1, wherein the housing portion comprises a front bottom edge rearwardly and indentedly extended towards a rear vision opening to form a front indented contour.

12. The protective cover of claim 11, wherein the housing portion comprises a rear bottom edge frontward and indentedly extended towards a vision opening to form a rear indented contour, wherein the rear vision opening is arranged on an opposite side of the vision opening.

13. The protective cover of claim 1, wherein the housing portion comprises two cover side walls, a front cover wall integrally extended from the two cover side walls, and a rear cover wall integrally extended from the two cover side walls to form a sloped wall, wherein each of the two cover side walls comprises a cover side wall height which is longer than a front cover wall height defined by the front cover wall.

14. The protective cover of claim 1, wherein the housing portion comprises two cover side walls, a front cover wall integrally extended from the two cover side walls, and a rear cover wall integrally extended from the two cover side walls, wherein each of the two cover side walls comprises a cover side wall height which is longer than a rear cover wall height defined by the rear cover wall.

15. The protective cover of claim 1, wherein the outer surface of the device comprises an indented slot integrally and transversely extended from one of two side walls of the device to a top portion of the device and the button arranged on the other one of the two side walls of the device.

16. The protective cover of claim 15, wherein the button is extended from a top edge of one of two side walls of the device to a bottom edge of the one of the two side walls of the device, wherein the top edge of the device is formed on an opposite side of the bottom edge of the device.

17. The protective cover of claim 1, wherein the at least one securing protrusion comprises a securing protrusion upwardly and integrally extended from the inner surface of one of two cover side walls of the cover body to the inner surface of a top cover wall of the cover body.

* * * * *